US005798736A

United States Patent [19]

Hall

[11] Patent Number: 5,798,736

[45] Date of Patent: Aug. 25, 1998

[54] ANTENNA SYSTEM HAVING A PLURALITY OF FUNDAMENTAL RESONANCES

[75] Inventor: Edward A. Hall, St. Louis, Mo.

[73] Assignee: McDonnell Douglas Corporation, St. Louis, Mo.

[21] Appl. No.: 412,070

[22] Filed: Mar. 28, 1995

[51] Int. Cl.[6] ..... H01Q 9/40

[52] U.S. Cl. ..... 343/791; 343/752; 343/830

[58] Field of Search ..... 343/790–792, 343/722, 749, 752, 825, 828–830, 846; H01Q 9/04, 9/16, 5/00, 5/01, 9/40

[56] References Cited

U.S. PATENT DOCUMENTS

| | | | |
|---|---|---|---|
| 2,112,287 | 3/1938 | Hansell et al. | 343/791 |
| 3,735,413 | 5/1973 | Woodward | 343/792 |
| 4,468,675 | 8/1984 | Robinson | 343/828 |
| 4,509,056 | 4/1985 | Ploussios | 343/791 |
| 5,311,201 | 5/1994 | Lillie et al. | 343/791 |

*Primary Examiner*—Michael C. Wimer

*Attorney, Agent, or Firm*—Bell Seltzer Intellectual Property Group of Alston & Bird, LLP

[57] ABSTRACT

An antenna which is adapted to have multiple fundamental resonances includes an outer conductor electrically connected to a feed network and having a generally tubular portion opening through one end to define an internal cavity therein. The antenna also includes an interior conductor electrically connected at a first end to a portion of the outer conductor within the internal cavity. The interior conductor extends through the opening defined in the outer conductor to a second end to thereby define an extended conductor portion which extends beyond the outer conductor. The antenna also includes decoupling means for electrically decoupling the extended conductor portion of the interior conductor from the antenna for signals having frequencies within the upper frequency band. In one embodiment, the internal conductor portion has a predetermined electrical length equal to an odd multiple of a quarter wavelength of a signal having a frequency in the upper frequency band of the antenna. Thus, the extended conductor portion is effectively electrically decoupled from the antenna for signals having frequencies within the upper frequency band.

10 Claims, 3 Drawing Sheets

ANTENNA SYSTEM HAVING A PLURALITY OF FUNDAMENTAL RESONANCES

FIELD OF THE INVENTION

The present invention relates generally to antenna systems and, more particularly, to antenna systems which have a plurality of fundamental resonances.

BACKGROUND OF THE INVENTION

One common type of antenna which is adapted to resonate within a predetermined frequency band is a monopole antenna. Monopole antennas generally have a relatively high Q and a relatively narrow bandwidth. Thus, monopole antennas are commonly employed for long range communications, commercial broadcasting and mobile use.

In a number of applications, it is desirable for an antenna, such as a monopole antenna, to resonate at two or more predetermined frequency bands. For example, a first frequency band can be employed by the antenna to transmit signals while a second predetermined frequency band can be employed by the antenna to receive signals. In order to provide an antenna having multiple fundamental resonances, monopole antennas having resonant traps have conventionally been employed.

In particular, a conventional monopole antenna having a resonant trap is connected at a first end to a feed network and at a second opposed end to a resonant trap structure. The resonant trap structure generally includes a capacitive element and an inductive element connected in parallel and extending from a first end at which they are connected to the monopole antenna to a second end at which they are connected to an outwardly extending conductor. In operation at lower frequencies, the resonant trap structure becomes principally inductive such that the entire length of the monopole antenna and the resonant trap structure, including the outwardly extending conductor, radiates. However, at higher frequencies, the resonant trap structure resonates, thereby effectively presenting an open circuit to the monopole antenna. At these higher frequencies, only the monopole antenna radiates, and not the resonant trap structure including the outwardly extending conductor.

Conventional monopole antennas having a resonant trap structure do provide multiple fundamental resonances, that is, the antenna resonates in at least high and low frequency bands. However, conventional monopole antennas having a resonant trap structure suffer from several deficiencies. For example, the parallel capacitive and inductive circuit which form the resonant trap structure typically increases the overall resistance of the antenna and thereby decreases the Q of the antenna. In addition, conventional monopole antennas having a resonant trap structure generally require mechanical attachment of the resonant trap structure to the monopole antenna. This mechanical attachment may decrease the physical integrity of the antenna and, in some instances, increase the physical size of the antenna. Further, the physical size of the resonant trap structure can increase the profile of the monopole antenna which generally results in an increased wind resistance potential.

SUMMARY OF THE INVENTION

It is therefore an object of the present invention to provide an improved antenna which has a plurality of fundamental resonances.

It is another object of the present invention to provide an improved monopole antenna which has a plurality of fundamental resonances.

It is still another object of one embodiment of the present invention to provide an improved monopole antenna which is adapted to resonate in a plurality of predetermined frequency bands and which in many instances has a greater efficiency and, correspondingly, a higher Q than conventional monopole antennas which have a resonant trap structure.

These and other objects are provided, according to the present invention, by an antenna adapted to resonate in at least an upper frequency band and a lower frequency band and including an outer conductor, an interior conductor which has an extended conductor portion extending beyond the outer conductor, and decoupling means for electrically decoupling the extended conductor portion of the interior conductor from the antenna for signals having frequencies within the upper frequency band. Thus, within the upper frequency band, the extended conductor portion of the interior conductor is electrically decoupled such that only the outer conductor resonates. In contrast, for signals having a frequency within the lower frequency band, both the outer conductor and the extended conductor portion of the inner conductor resonate.

The outer conductor generally has opposed first and second ends and is electrically connected to a feed network. The second end of the outer conductor preferably defines an opening in communication with an internal cavity defined therein. A first end of the interior conductor extends within the internal cavity and is electrically connected to the outer conductor. In addition, the second end of the interior conductor extends through the opening defined by the second end of the outer conductor to thereby define an internal conductor portion and the extended conductor portion. The internal conductor portion is positioned within the outer conductor and the extended conductor portion extends beyond the second end of the outer conductor.

According to one embodiment, the extended conductor portion is electrically decoupled from the antenna for signals having frequencies within the upper frequency band due to the predetermined electrical length of the internal conductor portion. Preferably, the internal conductor portion has a predetermined electrical length equal to an odd multiple of a quarter wavelength of a signal having a frequency within the upper frequency band.

The antenna of the present invention can also include upper frequency band shifting means and lower frequency band shifting means for controllably shifting the upper frequency band and the lower frequency band, respectively, of the antenna. In one embodiment, the upper frequency band shifting means includes a conductive extension connected at a first end to the feed network and at a second end to the first end of the outer conductor. In another embodiment, the upper frequency band shifting means includes a base loading impedance element, such as an inductor, disposed between the first end of the outer conductor and the feed network.

The antenna of one embodiment of the present invention can include length controlling means for controlling the electrical length of the internal conductor portion of the interior conductor. In one embodiment, the length controlling means includes a reactive impedance element, such as a capacitor, disposed between the first end of the interior conductor and the outer conductor. In another embodiment, the length controlling means includes a reactive impedance element disposed between the first end of the outer conductor and a reference voltage, such as a ground plane. In yet another embodiment, the length controlling means includes a reactive impedance element disposed between the first end of the interior conductor and the reference voltage.

In an alternative embodiment, the length controlling means of the antenna can include one or more conductive disks to control the electrical length of the antenna. For example, an annular conductive disk can be electrically connected to the second end of the outer conductor. Alternatively, a conductive disk can be connected to the second end of the interior conductor instead of or in addition to the annular conductive disk attached to the outer conductor.

Further, the antenna of the present invention can include dielectric material disposed within the internal cavity of the outer conductor and about the interior conductor. In particular, the antenna can include a coaxial cable having a predetermined impedance. The coaxial cable includes an annular outer conductor and a center conductor extending longitudinally through the annular outer conductor. In addition, the dielectric material can also be disposed between the annular outer conductor and the center conductor. In this embodiment, the annular outer conductor includes the outer conductor of the antenna while the center conductor includes the interior conductor of the antenna. Accordingly, the antenna of the present invention can be constructed of coaxial cable to thereby form a relatively inexpensive monopole antenna which has a plurality of fundamental resonances.

The antenna of the present invention can also include impedance adjusting means for controllably adjusting the impedance of the antenna such that the frequency bands in which the antenna resonates are broadened. In particular, the impedance adjusting means can include at least one tuning stub electrically connected between the first end of the outer conductor and the feed network. Each tuning stub preferably includes a tubular outer conductor and an inner conductor extending longitudinally therethrough. A first end of the inner conductor is preferably connected to the feed network and a second, opposed end of the inner conductor is advantageously connected to the tubular outer conductor. In addition, the tubular outer conductor is generally connected to a reference voltage, such as a ground plane. As described above, the tuning stub can also be a portion of a coaxial cable.

According to another embodiment in which the antenna is adapted to resonate in a plurality of frequency bands, the antenna includes an outer conductor and a plurality of interior conductors electrically connected at the respective first ends to the outer conductor. The plurality of interior conductors are nested to thereby define an outermost conductor and a plurality of inner conductors. Each inner conductor has a second end which extends longitudinally beyond the adjacent interior conductor which is positioned in an at least partially surrounding relationship thereto. Thus, each inner conductor defines an extended conductor portion which extends longitudinally beyond the at least partially surrounding adjacent interior conductor. The decoupling means of this embodiment preferably electrically decouples the extended conductor portion of at least one of the interior conductors from the antenna for signals having frequencies within each of the frequency bands.

The antenna of another embodiment of the present invention which electrically decouples the extended conductor portion from the antenna for signals having frequencies within the upper frequency band includes an interior conductor having a first end which extends within the internal cavity defined by the outer conductor in a spaced apart relationship from the outer conductor. In this embodiment, the internal conductor portion of the interior conductor has a predetermined electrical length equal to a multiple of a half wavelength of a signal having a frequency in the upper frequency band of the antenna.

According to this embodiment, the outer conductor and the interior conductor can be formed in a generally U-shape. Consequently, the U-shaped outer conductor and the U-shaped interior conductor have a curved lower portion and a pair of arms extending upwardly therefrom. The outer conductor of this embodiment is generally electrically connected to the feed network within the curved lower portion of the antenna. Thus, the upper frequency band of the antenna can be controlled by the resulting length of the longer of the pair of upwardly extending arms.

Further, an antenna according to another embodiment of the present invention is adapted to resonate in a plurality of frequency bands including a predetermined low frequency band, a predetermined high frequency band and at least one intermediate frequency band. The antenna of this embodiment includes a base radiating conductor having a longitudinally extending tubular portion which is electrically connected to the feed network so as to resonate in each of the plurality of frequency bands. A plurality of inner conductors are also electrically connected at their respective first ends to the base radiating conductor and extend through at least a portion of the internal cavity thereof. For example, the base radiating conductor and the plurality of inner conductors can comprise a twin-axial cable.

The antenna of this embodiment also includes at least one intermediate radiating element connected to a respective inner conductor and defining a longitudinally extending bore through which at least one of the inner conductors extends. Each intermediate radiating element is adapted to resonate within each frequency band from the predetermined low frequency to a predetermined maximum intermediate frequency band. The antenna can also include a termination radiating conductor connected to a respective inner conductor and adapted to resonate in the low frequency band.

Further, the decoupling means of this antenna electrically decouples each respective intermediate radiating element from the antenna for signals having frequencies within a frequency band in which the antenna is adapted to resonate and which are higher than the predetermined maximum frequency band in which the respective intermediate radiating element resonates. The decoupling means also electrically decouples the termination radiating conductor for signals within a frequency band in which the antenna is adapted to resonate and which are higher than the low frequency band.

An antenna of yet another embodiment of the present invention is adapted to resonate in at least an upper frequency band and a lower frequency band and includes first and second driven dipole arms. Each driven dipole arm includes an outer conductor electrically connected to the feed network, an interior conductor electrically connected at a first end to a portion of the outer conductor within the internal cavity and decoupling means for electrically decoupling the extended conductor portions of the interior conductors of both of the first and second driven dipole arms for signals having frequencies within the upper frequency band.

The first and second driven dipole arms can, in one embodiment, comprise a driven element which, in combination with one or more director elements and one or more reflector elements, can comprise a yagi antenna. In this embodiment, each of the director and reflector elements include first and second passive dipole arms. Each passive dipole arm includes an outer conductor and an associated interior conductor. According to this embodiment, the decoupling means also includes means for electrically decoupling the extended conductor portions of the interior conductors of the first and second passive dipole arms of the director and reflector elements from the antenna for signals having frequencies within the upper frequency band. Thus, the resulting yagi antenna can resonate in at least two distinct frequency bands.

Accordingly, the antenna of the present invention provides multiple fundamental resonances without requiring physically cumbersome resonant trap structures. In addition, the antenna of the present invention has a relatively high Q such that signals can be efficiently transmitted and received. In one embodiment of the present invention, the antenna is configured as a monopole antenna which does not significantly increase the wind resistance potential of the platform on which the monopole antenna is mounted. The monopole antenna embodiment of the present invention can also be economically fabricated from a coaxial cable stub.

DETAILED DESCRIPTION OF THE PREFERRED EMBODIMENTS

Figure 1:
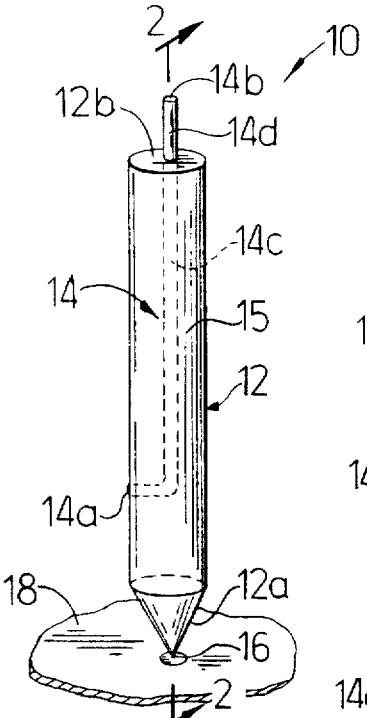
FIG. 1 is a perspective view of a monopole antenna of one embodiment of the present invention.

Various methods and apparatus embodiments of the invention are set forth below. While the invention is described with reference to specific preferred methods and apparatus including those illustrated in the drawings, it will be understood that the invention is not intended to be so limited. To the contrary, the invention includes numerous alternatives, modifications and equivalents as will become apparent from consideration of the present specification including the drawings, the foregoing discussion, and the following detailed description. Like numbers refer to like elements throughout.

Referring now to FIG. 1, an antenna 10 according to one embodiment of the present invention is illustrated. The antenna has multiple fundamental resonances or, in other words, is adapted to resonate in at least an upper frequency band and a lower frequency band. Consequently, the antenna is particularly well suited for communications applications in which the antenna transmits signals in a first frequency band and receives signals in a second frequency band. However, it will be apparent that the antenna of the present invention can be employed in other applications without departing from the spirit and scope of the present invention.

Figure 2:
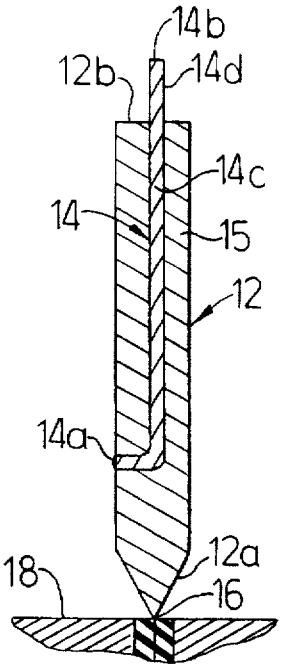
FIG. 2 is a cross-sectional view of the monopole antenna illustrated in FIG. 1 taken along line 2—2.

In the embodiment of the present invention illustrated in FIGS. 1 and 2, the antenna 10 can be configured as a monopole antenna having an outer conductor 12 and an interior conductor 14. The outer conductor has opposed first and second ends **12*a* and 12*b*** and defines an internal cavity therein. For example, the outer conductor can be an annular or tubular outer conductor and, in one more specific embodiment, can be a cylindrical tube. The second end of the outer conductor preferably defines an opening which is in communication with the internal cavity.

The outer conductor 12 is generally comprised of conductive material, such as brass or aluminum, and is electrically connected to a feed network (not shown) at a feed point 16. In the exemplary embodiment illustrated in FIGS. 1 and 2, the outer conductor is electrically connected to the feed network at a feed point located at the first end **12*a* of the outer conductor. However, the feed network can be electrically connected to the outer conductor at other positions as illustrated and described hereinafter without departing from the spirit and scope of the present invention. As also illustrated in FIGS. 1 and 2, the outer conductor is preferably connected to the feed network through an aperture defined in a ground plane 18**. As known to those skilled in the art, the ground plane is typically connected to a reference voltage, such as ground, so as to direct the reception or transmission pattern of the antenna outwardly or forwardly therefrom. In addition, a dielectric material, such as teflon, is typically disposed within the aperture and between the outer conductor and the ground plane.

For example, the outer conductor 12 can be connected to a feed network with an RF connector. As known to those skilled in the art, an RF connector typically includes a generally cylindrical, conductive outer portion, a center pin extending through the bore defined through the cylindrical outer portion, and a dielectric insulating material disposed between the center pin and the outer portion. Although not illustrated, the outer portion of the RF connector of this embodiment can be connected to the reference voltage while the center pin of the RF connector can be connected to the first end 12*a* of the outer conductor and to the feed network such that the antenna 10 can be driven thereby.

The antenna 10 of FIGS. 1 and 2 also includes an interior conductor 14 having opposed first and second ends 14*a* and 14*b*. The first end of the interior conductor preferably extends within the internal cavity defined by the outer conductor 12 and is electrically connected to the outer conductor. In particular, the interior conductor is preferably electrically connected to an interior wall of the outer conductor at a predetermined position. In addition, the second end of the interior conductor preferably extends through the opening defined by the second end 12*b* of the outer conductor. Thus, the interior conductor thereby defines an internal conductor portion 14*c* which is positioned within the outer conductor and an extended conductor portion 14*d* which extends beyond the second end of the outer conductor. Typically, the interior conductor extends longitudinally through the internal cavity of the outer conductor in a generally spaced apart relationship therefrom so as to only electrically contact the outer conductor at the one predetermined position therein.

The antenna 10 of the present invention also includes decoupling means for electrically decoupling the extended conductor portion 14*d* of the interior conductor 14 from the antenna for signals having frequencies within the upper frequency band. Thus, although the antenna is adapted to resonate at both an upper frequency band and a lower frequency band, only the outer conductor 12 resonates within the upper frequency band. In contrast, both the outer conductor and extended conductor portion of the interior conductor resonate within the lower frequency band.

According to one embodiment, the extended conductor portion 14*d* of the interior conductor 14 is electrically decoupled for signals having frequencies within the upper frequency band due to the electrical length of the internal conductor portion 14*c* of the interior conductor. In particular, the electrical length of the internal conductor portion of the interior conductor is preferably equal to an odd multiple of a quarter wavelength of a signal having a frequency in the upper frequency band of the antenna. Thus, for signals having a frequency $f_{upper}$ within the upper frequency band of the antenna and a corresponding wavelength of $\lambda_{upper}$, the predetermined electrical length of the internal conductor portion is preferably $n\lambda_{upper}/4$ wherein n is a positive odd integer, such as $\lambda_{upper}/4$, $3\lambda_{upper}/4$, $5\lambda_{upper}/4$ . . .

According to this embodiment of the present invention, the predetermined electrical length of the internal conductor portion 14*c* effectively electrically decouples the extended conductor portion 14*d* from the antenna 10 since the impedance of a conductor reverses every quarter of a wavelength. More particularly, the interior conductor is connected or shorted to the outer conductor 12 at a first end 14*a* resulting in little, if any, impedance between the interior and outer conductors at the first end of the interior conductor. Thus, for embodiments of the antenna in which the internal conductor portion has a predetermined electrical length equal to a odd multiple of a quarter wavelength of a signal having frequency within the upper frequency band of the antenna, the interior conductor will appear to have an open circuit between the internal conductor portion and the extended conductor portion, at least with respect to the outer conductor. Therefore, the extended conductor portion is effectively electrically decoupled or cut off from the antenna and, more specifically, from the internal conductor portion for signals in the upper frequency band.

In one embodiment, the antenna 10 also includes dielectric material, such as air, disposed between the outer conductor 12 and the interior conductor 14. In the embodiment in which an air dielectric is disposed between the outer conductor and the interior conductor, the antenna also preferably includes insulator rings (not shown) disposed within the internal cavity of the outer conductor in a longitudinally spaced apart relationship to support the interior conductor in a predetermined spaced apart relationship from the outer conductor.

As will be apparent to those skilled in the art, the wavelength of the signals which the antenna 10 is adapted to resonate in the upper frequency band will depend, in part, upon the velocity of propagation of the signals within the internal cavity of the outer conductor 12. In particular, the velocity of propagation varies as a function of the inverse square root of the dielectric constant $\epsilon_R$ of the dielectric material. Thus, the predetermined electrical length of the internal conductor portion 14*c* of the interior conductor 14 is preferably equal to an odd multiple of a quarter wavelength of a signal having a frequency $f_{upper}$ within the upper frequency band of the antenna wherein the wavelength $\lambda_{upper}$ of the signal is determined by its propagation within the dielectric material between the outer conductor and the interior conductor. Thus, by properly selecting the dielectric material, the physical length of the internal conductor portion of the interior conductor can be varied.

Figure 3:
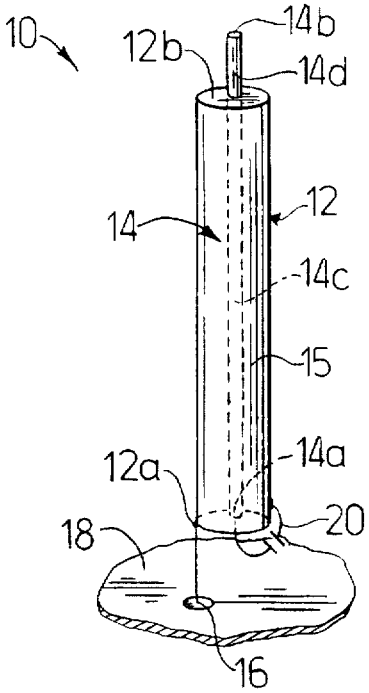
FIG. 3 is a perspective view of a monopole antenna of one embodiment of the present invention illustrating a greatly enlarged reactive impedance element disposed between the outer and interior conductors for controlling the length of the interior conductor.

According to the present invention, the electrical length of the internal conductor portion 14*c* of the interior conductor 14 can also be varied in relation to the physical length of the interior conductor by including length controlling means for controlling the electrical length of the internal conductor portion of the interior conductor. As illustrated schematically in FIG. 3, the length controlling means of one embodiment includes a reactive impedance element 20, such as a capacitor and, more particularly, such as a chip capacitor, disposed between the first end 14*a* of the interior conductor and the outer conductor 12.

Thus, by properly selecting the amount of reactive impedance, the physical length of the internal conductor portion 14*c* can equal the physical length of the outer conductor 12. Consequently, fabrication of the antenna 10 of the present invention can be simplified. For example, for an antenna having a dielectric material disposed between the outer and interior conductors which has a dielectric constant $\epsilon_R$ of 1.52 and which is adapted to resonate in an upper frequency band of approximately 300 MHz, a 100 pF capacitor can be provided between the first end of the interior conductor 14 and the first end 12*a* of the outer conductor such that both the internal conductor portion of the interior conductor and the outer conductor can have the same physical length while maintaining the electrical length of the internal conductor portion as an odd multiple of a quarter wavelength of the signals transmitted in the upper frequency band.

In another embodiment illustrated in FIG. 9 and described in detail hereinafter, the length controlling means can include one or more reactive impedance elements 20, such as capacitors. In this embodiment, a first capacitor can be disposed between the first end 12*a* of the outer conductor 12 and the ground plane 18. Alternatively, a second capacitor can be disposed between the first end 14*a* of the interior conductor 14 and the ground plane. Still further, the length controlling means can include capacitors disposed between the respective first ends of both the outer conductor and the interior conductor and the ground planes and capacitors disposed between the first ends of the interior conductor and the outer conductor as shown schematically in FIG. 9.

Figure 4:
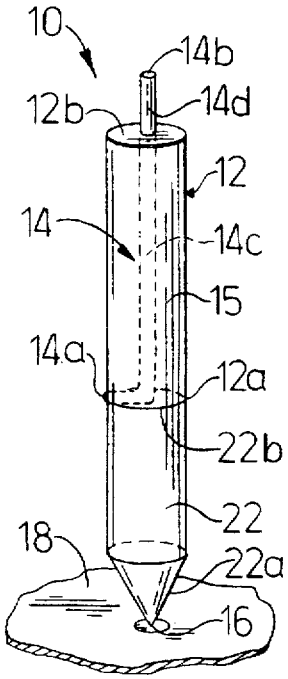
FIG. 4 is a perspective view of a monopole antenna of one embodiment of the present invention illustrating a conductive extension disposed between the outer conductor and the feed network for controllably adjusting the upper frequency band of the antenna.

The upper frequency band of the antenna 10 of the present invention is generally controlled by the longitudinal length of the outer conductor 12. In one embodiment, the antenna of the present invention can include upper frequency band shifting means for controllably shifting the upper frequency band $f_{upper}$ of the antenna. As illustrated in FIG. 4, the upper frequency band shifting means can include a conductive extension 22 connected at a first end 22*a* to the feed network and at a second end 22*b* to the first end 12*a* of the outer conductor. As also illustrated in FIG. 4, the conductive extension can have the same general exterior shape as the outer conductor but can be either tubular or solid. Thus, by effectively lengthening the outer conductor, the upper frequency band in which the antenna is adapted to resonate is decreased.

More specifically, the upper frequency $f_{upper}$ at which the antenna 10 resonates is generally defined as:

$$f_{upper}=V_p/4L$$

wherein $V_p$, is the velocity of propagation in the medium, such as air, surrounding the antenna, and L is the physical length of the antenna. Thus, by lengthening the antenna, the upper frequency band in which the antenna resonates decreases.

Figure 5:
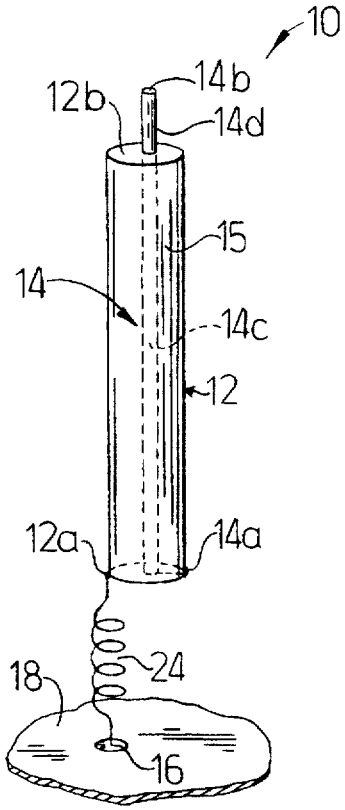
FIG. 5 is a perspective view of a monopole antenna of one embodiment of the present invention illustrating a greatly enlarged base loading impedance element disposed between the outer conductor and the feed network for controllably adjusting the upper frequency bands of the antenna.

In another embodiment illustrated in FIG. 5, the upper frequency band shifting means includes a base loading impedance element 24 disposed between the first end 12*a* of the outer conductor 12 and the feed network. As illustrated schematically in FIG. 5, the base loading impedance element can include an inductor. As will be apparent to those skilled in the art, an inductor is physically small such that the length and corresponding wind resistance of the antenna is not significantly increased. However, the effective electrical length of the outer conductor is increased by the base loading impedance element such that the upper frequency band in which the antenna is adapted to resonate is decreased.

In a similar fashion, the lower frequency band of the antenna 10 of the present invention is dependent upon the electrical length of the extended conductor portion 14*d* of the interior conductor 14. Thus, the antenna of the present invention can include lower frequency band shifting means for controllably shifting the lower frequency band of the antenna. In particular, the length of the extended conductor portion can be varied which, in turn, alters the lower frequency band in which the antenna is adapted to resonate. In particular, by lengthening the extended conductor portion, the lower frequency band of the antenna decreases. Likewise, by shortening the extended conductor portion of the antenna, the lower frequency band of the antenna increases.

Figure 6:
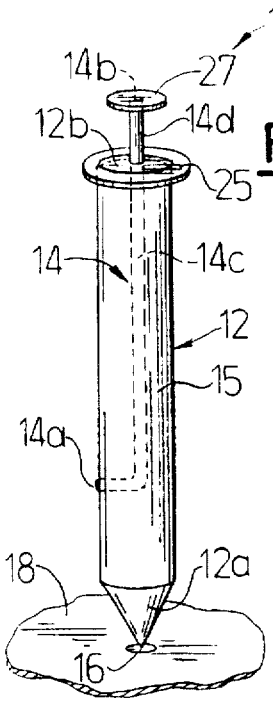
FIG. 6 is a perspective view of a monopole antenna of one embodiment of the present invention which includes conductive disks or top hats mounted to both the outer conductor and the interior conductor.

As illustrated in FIG. 6, the length controlling means of the monopole antenna 10 can also include one or more conductive disks or top hats which increase the effective electrical length of the antenna and adjust the frequency bands in which the antenna resonates as described below. As shown, an annular conductive disk 25 can be electrically connected to the second end 12*b* of the outer conductor 12 so as to extend radially outward therefrom. By appropriately selecting the surface area of the conductive disk as known to those skilled in the art, the effective length of the outer conductor can be increased so as to decrease the upper frequency band of the antenna, without requiring the addition of a base loading impedance element 24 or a conductive extension 22. Alternatively, the physical length of the outer conductor which includes the conductive disk can be reduced relative to an antenna which does not include a conductive disk while continuing to resonate at the same frequency. Thus, the materials cost and wind resistance potential of the antenna having one or more conductive disks can be correspondingly reduced. In addition, the physical length of the outer conductor can be reduced so as to equal the physical length of the internal conductor portion 14*c*, thereby simplifying the fabrication of the antenna.

In a like fashion, a conductive disk 27 can also be electrically connected to the second end 14*b* of the interior conductor 14. Thus, the antenna of this embodiment can include conductive disks mounted to the respective second ends of both the interior conductor and the outer conductor 12 as shown in FIG. 6. Alternatively, the antenna can include a single conductive disk mounted to the respective second end of either the interior conductor or the outer conductor.

In embodiments which include a conductive disk 27 mounted to the second end 14*b* of the interior conductor 14, the lower frequency band in which the antenna is adapted to resonate can generally be controlled by adjusting the size or the surface area of the conductive disk as known to those skilled in the art. In particular, the addition of a conductive disk to the second end of the interior conductor decreases the lower frequency band in which the antenna resonates. Alternatively, the physical length of an antenna having a conductive disk mounted to the second end of the interior conductor can be decreased while maintaining the same lower frequency band as an antenna which does not include a conductive disk mounted to the interior conductor.

The monopole antenna 10 of the present invention, as described above, can be comprised of a coaxial cable. The coaxial cable includes an annular outer conductor which serves as the outer conductor 12 of the antenna. In addition, the coaxial cable includes a center conductor extending longitudinally through the annular outer conductor. Consequently, the center conductor serves as the interior conductor 14 of the antenna. In addition, an annular layer of dielectric material 15 is generally disposed between the center conductor and the outer conductor of the coaxial cable. Thus, the monopole antenna of this embodiment can be efficiently and economically fabricated from a coaxial cable while still having multiple fundamental resonances. In addition, the monopole antenna of the present invention has a relatively high Q so as to efficiently transmit and receive signals.

As will be apparent to those skilled in the art, the coaxial cable which comprises one embodiment of the monopole antenna of the present invention has a predetermined impedance. By controllably selecting the impedance of the coaxial cable, the bandwidth of the upper frequency band in which the antenna is adapted to resonate can be controlled or, in some instances, broadened. Thus, by increasing the impedance of the coaxial cable, such as from a 50 ohm coaxial cable to a 90 ohm coaxial cable, the breadth of the upper frequency band can be controllably increased.

Figure 7:
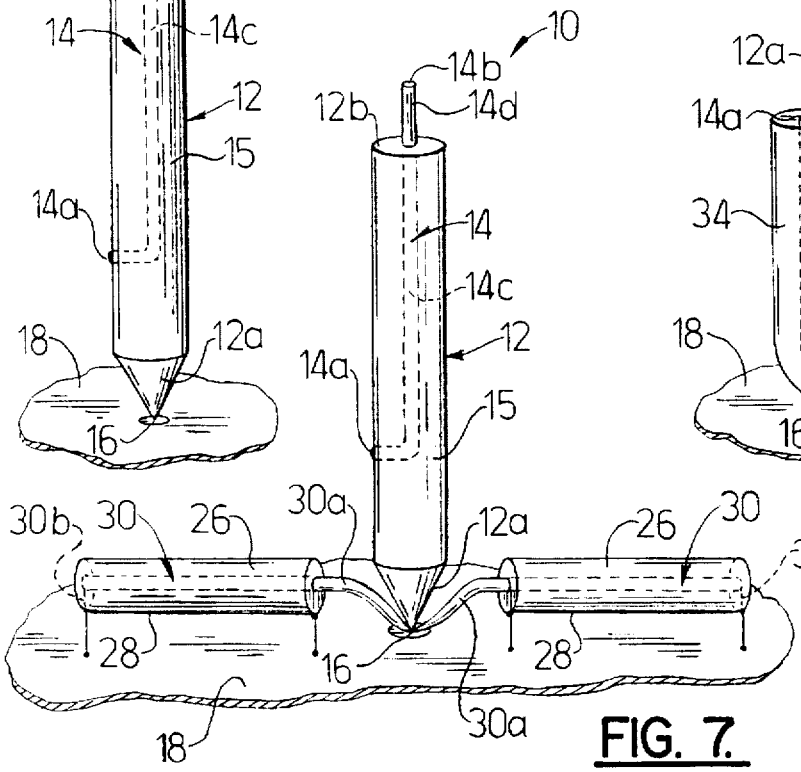
FIG. 7 is a perspective view of a monopole antenna of one embodiment of the present invention having a tuning stub for controllably adjusting the impedance of the antenna.

According to one embodiment, the antenna 10 of the present invention can include impedance adjusting means for controllably adjusting the impedance of the antenna. As illustrated in FIG. 7, the impedance adjusting means can include at least one tuning stub 26. More specifically, in the illustrated embodiment, the antenna includes a pair of parallel tuning stubs. By controllably adjusting the impedance of the antenna, the bandwidth and, in particular, the bandwidth of the upper frequency band can also be effectively broadened.

The tuning stubs 26 typically controllably adjust the impedance of the antenna 10 by effectively cancelling the reactance of the antenna. Therefore, the tuning stubs preferably having a relatively large input impedance at frequencies at which the antenna is resonant. For other frequencies in which the reactance of the antenna becomes capacitive or inductive, the reactance of the tuning stubs preferably becomes inductive or capacitive, respectively, so as to effectively cancel or offset the reactance of the antenna. Thus, the impedance of the antenna is controlled such that the resulting bandwidth of the antenna is broadened.

Each tuning stub 26 is electrically connected between the first end 12*a* of the outer conductor 12 and the feed network. Each tuning stub includes a tubular outer conductor 28 and an inner conductor 30 extending longitudinally therethrough from a first end 30*a* to an opposed second end 30*b*. For example, each tuning stub can be comprised of a coaxial cable having an annular outer conductor and a center conductor extending longitudinally therethrough. In addition, the first end of the inner conductor of the tuning stub is generally connected to the feed network while the second end is connected to the tubular outer conductor. As illustrated in FIG. 7, the tubular outer conductor is also connected to a reference voltage, such as ground. Accordingly, in this embodiment of the present invention, the ground plane 18 can be eliminated while still controlling the general direction of the transmission and reception patterns of the antenna 10. While two parallel tuning stubs are illustrated in FIG. 7, any number of tuning stubs could be connected in parallel at their respective first ends between the first end of the outer conductor and the feed network to further control the impedance of the antenna.

Figure 8:
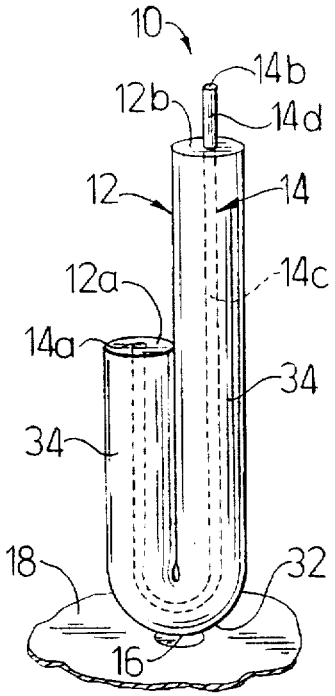
FIG. 8 is a perspective view of a monopole antenna of one embodiment of the present invention having an interior conductor which has a predetermined electrical length of a multiple of a half wavelength of a signal in the low frequency band in which the antenna is adapted to resonate and which is formed in a generally U-shape.

In another embodiment of the present invention illustrated in FIG. 8, the external conductor portion 14*d* of the interior conductor 14 is effectively electrically decoupled from the antenna 10 in another manner. In particular, the interior conductor extends within the internal cavity defined by the outer conductor 12, but does not electrically contact the outer conductor. Instead, the interior conductor extends in a spaced apart relationship to the outer conductor. In one embodiment, the outer conductor is the annular outer conductor of a coaxial cable and the interior conductor is the center conductor of the coaxial cable which extends longitudinally through the cylindrical cavity defined within the annular outer conductor.

In this embodiment, the internal conductor portion 14*c* preferably has a predetermined electrical length which is equal to a multiple of a half wavelength of a signal having a frequency $f_{upper}$ in the upper frequency band of the antenna. In other words, the predetermined electrical length of the internal conductor portion is preferably $n\lambda_{upper}/2$ wherein n is any positive integer.

As described above, the wavelength of a signal depends, at least in part, upon the dielectric constant $\epsilon_R$ of the dielectric material 15 disposed between the outer conductor 12 and the interior conductor 14. Thus, the predetermined electrical length of the internal conductor portion 14*c* is preferably equal to a multiple of a half wavelength of a signal having a frequency in the upper frequency band of the antenna wherein the wavelength is determined during propagation of the signal through the dielectric material within the internal cavity of the outer conductor.

The antenna 10 of this embodiment effectively electrically decouples the extended conductor portion 14*d* of the interior conductor 14 since the impedance of a conductor repeats every half wavelength of the signals propagating thereon. Thus, since the first end of the interior conductor is not electrically connected to or, alternatively, is open with respect to the outer conductor 12, an open circuit is also presented at the second end 12*b* of the outer conductor between the internal conductor portion 14*c* and exterior conductor portion of the interior conductor, thereby effectively electrically decoupling the external conductor portion from the antenna.

As also illustrated in FIG. 8, the antenna 10 of this embodiment can be formed in a complex shape, such as a generally U-shape. As illustrated, the generally U-shaped antenna has a curved lower portion 32 and a pair of arms 34 extending upwardly therefrom. As also illustrated, the outer conductor 12 is electrically connected to the feed network within the curved lower portion of the antenna. By forming the antenna in a complex shape, such as a generally U-shape, the height h of the antenna can be controlled and, consequently, the upper frequency band $f_{upper}$ in which the antenna is adapted to resonate can be controlled. In particular, the upper frequency band is generally controlled by the resulting length of the longer of the pair of upwardly extending arms such that by controllably forming the antenna in a generally U-shape, the upper frequency band can be optimized.

Figure 9:
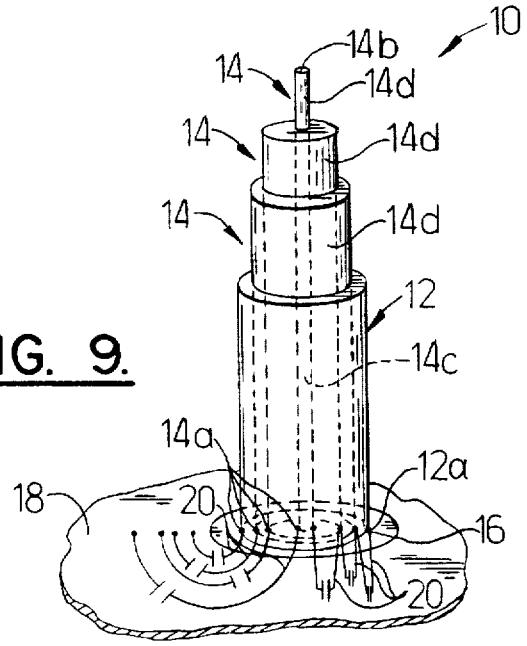
FIG. 9 is a perspective view of an antenna of one embodiment of the present invention having a plurality of nested interior conductors which is adapted to resonate in a predetermined high frequency band, a predetermined low frequency band, and at least one intermediate frequency band.

Another embodiment of an antenna 10 of the present invention is illustrated in FIG. 9. The antenna of this embodiment is adapted to resonate in a plurality of predetermined frequency bands. As shown, the antenna includes an outer conductor 12 electrically connected to a feed network and having a longitudinally extending tubular portion which defines an internal cavity therein. The antenna also includes a plurality of interior conductors 14 electrically connected at their respective first ends 14*a* to a portion of the outer conductor. The plurality of interior conductors are preferably nested to thereby define an outermost conductor and a plurality of inner conductors. Each inner conductor has a second end 14*b* which extends longitudinally beyond an adjacent interior conductor which is positioned in an at least partially surrounding relationship thereto. Thus, each inner conductor defines an extended conductor portion 14*d* which extends longitudinally beyond the at least partially surrounding adjacent interior conductor.

The antenna 10 of this embodiment also includes decoupling means for electrically decoupling the extended conductor portion 14*d* of at least one of the interior conductors 14 from the antenna for signals having frequencies within each of the frequency bands other than the lower frequency band. For example, for signals in the lower frequency band of the antenna, the outer conductor 12 and each of the extended conductor portions of the plurality of interior conductors are adapted to resonate. However, in the second frequency band in which the antenna is adapted to resonate, i.e., the second lowest frequency band, the extended conductor portion of the innermost inner conductor is electrically decoupled according to the present invention. Likewise, in the third frequency band in which the antenna is adapted to resonate, i.e., the third lowest frequency band, the extended conductor portions of both the innermost inner conductor and the second most innermost inner conductor are electrically decoupled. Finally, for signals having frequencies within the upper frequency band of the antenna, the extended conductor portions of each of the interior conductors are preferably electrically decoupled such that only the outer conductor resonates. Accordingly, the antenna of the embodiment illustrated in FIG. 9 is adapted to resonate a plurality of predetermined frequency bands.

As also illustrated in FIG. 9, each interior conductor 14 can include length controlling means, such as a reactive impedance element 20, typically a capacitor, for controlling the electrical length of the internal conductor portion 14*c* thereof. Thus, each internal conductor can extend downwardly to the same plane in which the first end 12*a* of the outer conductor 12 is positioned. Although not illustrated, the antenna 10 of this embodiment can also include upper frequency band shifting means, such as a conductive extension 22 to the outer conductor 12 or a base loading impedance element 24. Further, the respective lengths of each of the extended conductor portions 14*d* can be controlled such that the lower frequency bands are controllably shifted. In addition, dielectric material can be disposed between the outer conductor and each of the interior conductors and the antenna can include impedance adjusting means, such as a tuning stub 26, for controllably adjusting the impedance of the antenna.

Figure 10:
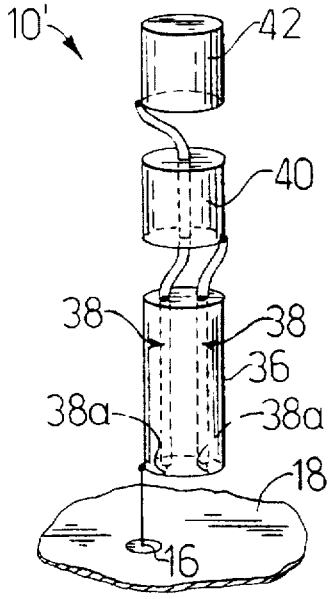
FIG. 10 is a perspective view of an antenna of one embodiment of the present invention having a base radiating conductor, at least one intermediate radiating conductor and a termination radiating conductor and which is adapted to resonate in a predetermined high frequency band, a predetermined low frequency band, and at least one intermediate frequency band.

Another embodiment of the antenna 10' of the present invention which is adapted to resonate in a plurality of predetermined frequency bands, including a predetermined low frequency band, a predetermined high frequency band and at least one intermediate frequency band between the low and high frequency bands is illustrated in FIG. 10. In this embodiment, the antenna includes a base radiating conductor 36 electrically connected to a feed network and having a longitudinally extending tubular portion defining an internal cavity therein. The base radiating conductor is adapted to resonate in each of the plurality of frequency bands. The antenna of this embodiment also includes a plurality of inner conductors 38 electrically connected at their respective first ends 38*a* to the base radiating conductor and extending through at least a portion of the internal cavity.

Further, the antenna 10' includes at least one intermediate radiating element 40 connected to a respective inner conductor 38 and defining a longitudinally extending bore therethrough. Although only a single intermediate radiating element is illustrated in FIG. 10, the antenna of this embodiment can include two or more intermediate radiating elements without departing from the spirit and scope of the present invention. Each intermediate radiating element is generally tubular and is adapted to resonate within each frequency band from the predetermined low frequency band to a predetermined maximum intermediate frequency band. At least one inner conductor preferably extends through the bore of each intermediate radiating element. The antenna 10' of this embodiment also includes a termination radiating conductor 42 connected to a respective inner conductor and adapted to resonate in the low frequency band.

As an example, the antenna 10' of this embodiment can include a twin-axial cable having an annular outer conductor and first and second inner conductors extending longitudinally therethrough. The annular outer conductor 36 serves as the base radiating conductor and the first and second inner conductors comprise the plurality of inner conductors 38. As illustrated, the first inner conductor is preferably connected to the intermediate radiating element 40. Further, the second inner conductor preferably extends longitudinally through the bore of the intermediate radiating element and is connected to the termination radiating conductor 42. This embodiment of the present invention also preferably includes decoupling means for electrically decoupling each respective intermediate radiating element 40 from the antenna 10 for signals having frequencies within a frequency band in which the antenna is adapted to resonate and which are higher than the predetermined maximum frequency band in which the intermediate radiating element resonates. The decoupling means of this embodiment also electrically decouples the termination radiating conductor for signals within a frequency band in which the antenna is adapted to resonate and which are higher than the low frequency band.

In the above example, the electrical length of each of the first and second inner conductors 38 from their respective first ends 38*a* at which they are connected to the annular outer conductor 36 to a point at the second or upper end of the annular outer conductor is preferably equal to a multiple of a quarter wavelength of the signals within the upper frequency band. Thus, both the termination radiating conductor 42 and the intermediate radiating element 40 are effectively electrically decoupled for signals within the upper frequency band of the antenna. In addition, the electrical length of the second inner conductor from its respective first end at which it is electrically connected to the annular outer conductor to the second or upper end of the intermediate radiating element is also preferably an odd multiple of a quarter wavelength of the signals which the antenna is adapted to resonate in the intermediate frequency band. Thus, the termination radiating conductor is effectively electrically decoupled for signals within the intermediate frequency band such that only the base radiating conductor and the intermediate radiating element resonate. Finally, for signals in the lower frequency band, each of the base radiating conductor, the intermediate radiating element and the termination radiating conductor resonate.

Thus, the antenna 10' of this embodiment has N fundamental resonances or, in other words, is adapted to resonate in N predetermined frequency bands. Accordingly, the antenna includes N−1 inner conductors 38 and N−2 intermediate radiating elements 40 electrically connected between the base radiating conductor 36 and the termination radiating conductor 42.

Figure 11:
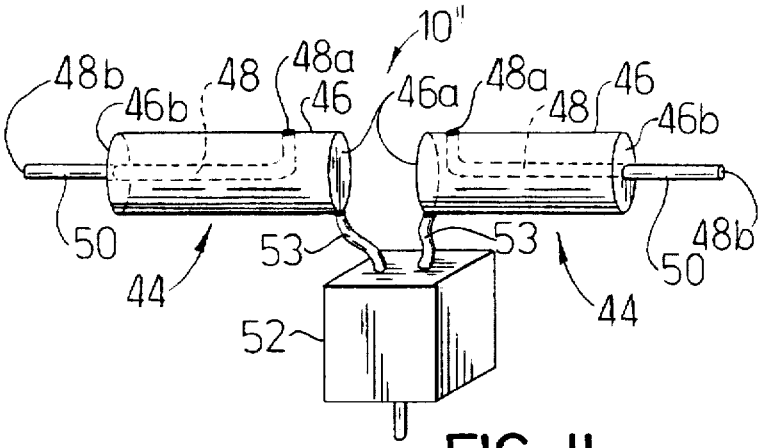
FIG. 11 is a perspective view of an antenna of one embodiment of the present invention having first and second driven dipole arms.

A further embodiment of an antenna 10" of the present invention is illustrated FIG. 11 and is adapted to resonate in at least an upper frequency band and a lower frequency band. As shown, the antenna includes first and second driven dipole arms 44. Each driven dipole arm includes an outer conductor 46 electrically connected to a feed network at a first end 46*a* and having a generally tubular portion opening through a second end 46*b*, opposite the first end. As described above, the generally tubular portion defines an internal cavity therein.

Each driven dipole arm 44 also includes an interior conductor 48 electrically connected at a first end 48*a* to a portion of the outer conductor 46 within the internal cavity. The interior conductor extends through the opening defined in the outer conductor to a second end 48*b*, opposite the first end, to thereby define an extended conductor portion 50 extending beyond the outer conductor.

As described above in conjunction with other embodiments of the present invention, the antenna 10" includes decoupling means for electrically decoupling the extended conductor portions 50 of the interior conductors 48 of both the first and second driven dipole arms 44 from the antenna for signals having frequencies within the upper frequency band. Thus, an antenna having first and second driven dipole arms according to the present invention can effectively resonate in both the predetermined upper frequency band and the predetermined lower frequency band. As illustrated in FIG. 11, the antenna including the first and second driven dipole arms can also include a balun 52 for improving the coupling of the antenna to the feed network so as to generally balance the currents to the coaxial feed line 53 and to broaden the bandwidth in which the antenna is adapted to resonate.

Although not specifically illustrated, the antenna 10" of the embodiment of FIG. 11 can include each of the features described above in conjunction with the monopole antenna. For example, the antenna 10" of this embodiment can include conductive extensions, base loading impedance elements, various dielectric materials, length controlling elements including reactive impedance elements, conductive disks and tuning stubs.

Figure 12:
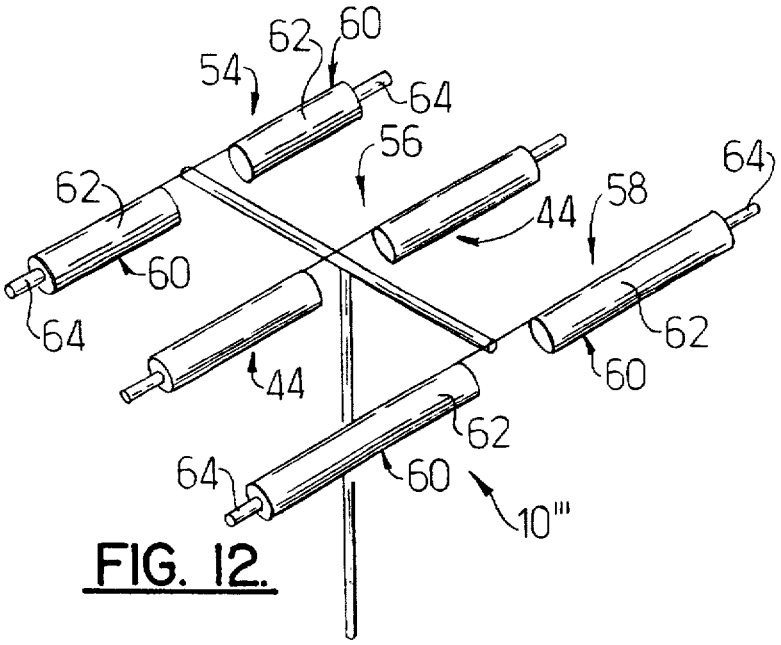
FIG. 12 is a perspective view of an antenna of one embodiment of the present invention which is configured as a yagi antenna and which includes a driven element comprised of the first and second driven dipole arms of FIG. 11 as well as director and reflector elements, each of which includes first and second passive dipole arms.

The first and second driven dipole arms 44 can be employed in a yagi antenna 10'", such as illustrated in FIG. 12. The yagi antenna includes one or more director elements 54, one or more driven elements 56 and one or more reflector elements 58. In particular, each driven element includes first and second driven dipole arms as described above. Further, each of the director and the reflector elements preferably includes first and second passive dipole arms 60.

Each passive dipole arm 60 preferably includes an outer conductor 62 having a generally tubular portion opening through one end thereof and defining an internal cavity therein. An interior conductor 64 is electrically connected at a first end to a portion of the outer conductor within the internal cavity and extends through the opening defined in the outer conductor to a second end, thereby defining an extended conductor portion.

The decoupling means of the yagi antenna 10'" of this embodiment also includes means for electrically decoupling the extended conductor portions of the interior conductors 64 of the first and second passive dipole arms 60 of each of the director and reflector elements 54 and 58 and the first and second driven dipole arms 44 of the driven element 54 from the antenna for signals having frequencies within the upper frequency band. Thus, the yagi antenna can effectively resonate in both an upper frequency band and a lower frequency band. In other words, the yagi antenna of this embodiment has two fundamental resonances. As an example, the yagi antenna can be adapted to operate on both the 15 meter shortwave band and the 17 meter shortwave bands so as to have center frequencies within the upper and lower frequency bands of approximately 21.2 megahertz and 18.1 megahertz, respectively.

Accordingly, the antenna 10 of the present invention provides multiple fundamental resonances without requiring physically cumbersome resonant trap structures. In addition, the antenna of the present invention has a relatively high Q such that signals can be efficiently transmitted and received. In one embodiment of the present invention, the antenna can be configured as a monopole antenna which does not significantly increase the wind resistance potential of the platform on which the monopole antenna is mounted. Further, the monopole antenna of the present invention can be economically fabricated from a coaxial cable stub, thereby reducing the cost of the antenna while maintaining or improving the antenna's performance.

In the drawings and the specification, there has been set forth a preferred embodiment of the invention and, although specific terms are employed, the terms are used in a generic and descriptive sense only and not for purpose of limitation, the scope of the invention being set forth in the following claims.

That which is claimed is:

1. An antenna adapted to resonate in a plurality of frequency bands without physically reconfiguring the antenna, wherein the antenna is adapted to resonate in a lower frequency band and at least one upper frequency band, the antenna comprising:

an outer conductor electrically conducted to a feed network, said outer conductor having a longitudinally extending tubular portion defining an internal cavity therein; and a plurality of interior conductors that are each directly connected and interconnected at their respective first ends to a portion of said outer conductor, wherein said plurality of interconnected interior conductors are nested to thereby define an outermost conductor and a plurality of inner conductors, and wherein each inner conductor has a second end which extends longitudinally beyond an adjacent interior conductor which is positioned in an at least partially surrounding relationship thereto such that each inner conductor defines an extended conductor portion which extends longitudinally beyond the at least partially surrounding adjacent interior conductor;

wherein the extended conductor portion of at least one of said interior conductors has a predetermined electrical length equal to an odd multiple of a quarter wavelength of a signal having a frequency in each upper frequency band of the antenna such that the extended conductor portion of at least one of said interior conductors is electrically decoupled from the antenna for signals having frequencies within each of the upper frequency bands.

2. An antenna according to claim 1 further comprising frequency band shifting means for controllably shifting at least one frequency band of the antenna.

3. An antenna according to claim 1 further comprising length controlling means for controlling the electrical lengths of an internal conductor portion of interior conductors.

4. An antenna according to claim 3 wherein said length controlling means comprises an annular conducive disk electrically connected to the second end of said outer conductor.

5. An antenna according to claim 3 wherein said length controlling means comprises a conducive disk electrically connected to the second end of at least one interior conductor.

6. An antenna according to claim 1 further comprising impedance adjusting means for controllably adjusting the impedance of the antenna such that the frequency bands are broadened.

7. An antenna adapted to resonate in a plurality of frequency bands, the antenna comprising:

an outer conductor electrically connected to a feed network, said outer conductor having a longitudinally extending tubular portion defining an internal cavity therein;

a plurality of interior conductors electrically connected at their respective first ends to a portion of said outer conductor, wherein said plurality of interior conductors are nested to thereby define an outermost conductor and a plurality of inner conductors, and wherein each inner conductor has a second end which extends longitudinally beyond an adjacent interior conductor which is positioned in an at least partially surrounding relationship thereto such that each inner conductor portion which extends longitudinally beyond the at least partially surrounding adjacent interior conductor; and length controlling means for controlling the electrical lengths of the internal conductor portion of said interior conductors, wherein said length controlling means is selected from the group consisting of a reactive impedance element disposed between the first end of said interior conductor and said outer conductor, a reactive impedance element disposed between the respective first end of said outer conductor and a ground plane, and a reactive impedance element disposed between the respective first end of said interior conductor and a ground plane;

wherein the extended conductor portion of at least one of said interior conductors has a predetermined electrical length equal to an odd multiple of a quarter wavelength of a signal having a frequency in each upper frequency band of the antenna such that the extended conductor portion of at least one of said interior conductors is electrically decoupled from the antenna for signals having frequencies within each of the upper frequency bands.

8. An antenna adapted to resonate in a plurality of frequency bands including a predetermined low frequency band, a predetermined high frequency band and at least one intermediate frequency band between the low and high frequency bands without physically reconfiguring the antenna, the antenna comprising:

a base radiating conductor electrically connected to a feed network, wherein said base radiating conductor has a longitudinally extending tubular portion defining an internal cavity therein, and wherein said base radiating conductor is adapted to resonate in each of the plurality of frequency bands;

a plurality of inner conductors that are each directly connected at their respective first ends to said base radiating conductor and extending through at least a portion of the internal cavity;

at least one intermediate radiating element spaced from said base radiating conductor, each intermediate radiating element being connected to a respective inner conductor and defining a longitudinally extending bore therethrough, wherein each intermediate radiating element is adapted to resonate within each frequency band from the predetermined low frequency band to a predetermined maximum intermediate frequency band, and wherein at least one inner conductor extends through the bore of said intermediate radiating element; and a termination radiating conductor spaced from said base radiating conductor and each intermediate radiating element, said termination radiating conductor being connected to a respective inner conductor and adapted to resonate in the low frequency band;

wherein each inner conductor extends beyond said base radiating conductor to thereby define a respective extended conductor portion, and wherein the extended conductor portion of at least one of said inner conductors has a predetermined electrical length equal to an odd multiple of a quarter wavelength of a signal having a frequency in each of the intermediate and high frequency bands of the antenna such that each respective intermediate radiating element is electrically decoupled from the antenna for signals having frequencies within a frequency band in which the antenna is adapted to resonate and which are higher than the predetermined maximum frequency band in which the respective intermediate radiating element resonates, and such that said termination radiating conductor is electrically decoupled from the antenna for signals within a frequency band in which the antenna is adapted to resonate and which are higher than the low frequency band.

9. An antenna according to claim 8 comprising a twin-axial cable having an annular outer conductor and a first and second inner conductors extending longitudinally therethrough, wherein said annular outer conductor comprises said base radiating conductor, and wherein said first and second inner conductors comprise said plurality of inner conductors.

10. An antenna according to claim 9 wherein said first inner conductor is connected to said intermediate radiating element, and wherein said second inner conductor extends longitudinally through the bore of said intermediate radiating element and is connected to said termination radiating conductor.

* * * * *

UNITED STATES PATENT AND TRADEMARK OFFICE

CERTIFICATE OF CORRECTION

PATENT NO. : 5,798,736

DATED : August 25, 1998

INVENTOR(S) : Hall

It is certified that error appears in the above-identified patent and that said Letters Patent is hereby corrected as shown below:

Column 16, line 7, "conducted" should be --connected--; line 38, before interior, insert --said--; line 41, "conducive" should be --conductive--; line 45, "conducive" should be --conductive--; line 66, after conductor, insert --defines an internal conductor portion and an extended conductor--.

Signed and Sealed this

Eighth Day of December, 1998

Bruce Lehman

*Attest:*

BRUCE LEHMAN

*Attesting Officer*

*Commissioner of Patents and Trademarks*